US007258113B2

(12) United States Patent
Pilpel et al.

(10) Patent No.: US 7,258,113 B2
(45) Date of Patent: Aug. 21, 2007

(54) THERMOPLASTIC COMPOSITE BOW RISER, LIMB, AND CAM

(75) Inventors: Edward Pilpel, Avon, CT (US); Joel S. Dyksterhouse, Cross Village, MI (US)

(73) Assignee: Gordon Composites, Inc., Montrose, CO (US)

( * ) Notice: Subject to any disclaimer, the term of this patent is extended or adjusted under 35 U.S.C. 154(b) by 0 days.

(21) Appl. No.: 11/063,420

(22) Filed: Feb. 22, 2005

(65) Prior Publication Data

US 2005/0229912 A1 Oct. 20, 2005

Related U.S. Application Data

(60) Provisional application No. 60/546,005, filed on Feb. 19, 2004.

(51) Int. Cl.
*F41B 5/00* (2006.01)

(52) U.S. Cl. ..... 124/23.1; 124/88

(58) Field of Classification Search ..... 124/23.1, 124/25.6, 86, 88

See application file for complete search history.

(56) References Cited

U.S. PATENT DOCUMENTS 213,851 A * 4/1879 Streeter ..... 124/23.1
3,657,040 A * 4/1972 Shobert ..... 156/178
3,766,904 A * 10/1973 Izuta ..... 124/23.1
4,693,230 A * 9/1987 Sugouchi ..... 124/88
4,733,647 A * 3/1988 Mattheck ..... 124/23.1
5,269,284 A * 12/1993 Pujos et al. ..... 124/88
5,534,213 A * 7/1996 Epling ..... 264/328.1
5,718,212 A * 2/1998 Allshouse et al. ..... 124/25.6

* cited by examiner

*Primary Examiner*—John A. Ricci
(74) *Attorney, Agent, or Firm*—Michaud-Duffy Group LLP

(57) ABSTRACT

A riser for an archery bow is formed from a fibrous composite material, the matrix of which may be a high heat distortion thermoplastic polymer, a very high heat distortion thermoplastic polymer, or a combination thereof. The riser may incorporate a spine formed from a different polymer or composite than the rest of the riser, or from metal. A method for producing a riser for an archery bow includes the steps of introducing a polymeric composite into a mold from a first end of the mold to facilitate a particular orientation of components of the polymeric composite, molding the polymeric composite to produce a billet that approximates a net shape of the riser, and then machining the billet to the final shape of the riser.

15 Claims, 10 Drawing Sheets

THERMOPLASTIC COMPOSITE BOW RISER, LIMB, AND CAM

CROSS REFERENCE TO RELATED APPLICATION

This application claims the benefits of U.S. Provisional patent application Ser. No. 60/546,005 filed on Feb. 19, 2004, the contents of which are herein incorporated by reference in their entirety.

FIELD OF THE INVENTION

This invention is directed to archery bows and, more particularly, to archery bows having risers and limbs fabricated from polymers and composite materials.

BACKGROUND OF THE INVENTION

The design of bows for use in archery has evolved over thousands of years. Changes in technology have been the result of mechanical innovation and advancement in material science. One significant advancement in bow design was the development of the "compound" bow. Traditional bows are referred to as "recurve" bows. Recurve bows are usually made from wood and must be bent into the curved bow shape each time a user wishes to attach the bow string. Recurve bows employ a single bow string and the resilience of the bow places the bow string in tension. While effective, it usually requires a great deal of force to draw the bowstring back when using a recurve bow. Contrastingly, compound bows employ a camming system that allows a user to exert less force on the bow string to draw it back than is necessary with a similarly rated recurve bow.

Major components of compound bows are the riser (on which a handle is mounted or formed) and two generally opposed limbs, each extending from an end of the riser. The limbs may be mounted in pockets at the ends of the riser and have pulleys or cams rotatably attached to the distal ends of each limb. A drawstring and harness system is wound between the pulleys and cams. Upon drawing the drawstring back, the limbs flex to allow the drawstring and the harness system to be loaded under high tension. In turn, the riser is loaded as a result of bending and torsional forces transferred thereto. These forces are resolved in the riser as tension, compression, shear forces, and torque.

Typically, the riser is fabricated from metal such as aluminum or magnesium or from composite materials that generally lack any appreciable amount of elasticity. The limbs, on the other hand, are typically fabricated from a material having a sufficient amount of resiliency (for example, woven unidirectional epoxy fiberglass and/or co-mingled composite materials) to allow them to flex or bend, thereby placing the bowstring in tension. Accordingly, upon drawing the bowstring back on a bow having a riser fabricated from a substantially inelastic material and limbs that are by comparison more flexible, undesirable stresses are introduced into the bow, particularly at the joints between the riser and the limbs. Over time, these stresses may compromise the structural integrity of the bow.

Furthermore, in bows and crossbows having risers fabricated from substantially inelastic materials, the opportunity for stress-related cracking to develop as a result of repeated use increases. Climatic changes (e.g., high temperature that results in increased creep or degradation of the composite matrix or the adhesives used, variations in humidity, and the like) can also contribute to the deterioration of the microstructure of the material of the riser, which can in turn significantly reduce the useful life of the bow. Moreover, deterioration of the microstructure can lead to visible defects in the riser that detract from the overall appearance of the bow.

Based on the foregoing, it is the general object of the present invention to provide an archery bow having components fabricated from a material that overcomes the problems of, or improves upon, the prior art.

SUMMARY OF THE INVENTION

According to one aspect of the present invention, a riser for an archery bow is formed to a desired shape from a fibrous composite material, the matrix of which may be a high heat distortion thermoplastic polymer, a very high heat distortion thermoplastic polymer, or a combination thereof. Thermoplastic polymers are polymers that soften when exposed to heat and harden to their original condition when cooled. The terms "high heat distortion" and "very high heat distortion" are used to describe the resistance to change in mechanical properties of the thermoplastic polymer due to increased temperature. As used herein, the term "archery bow" is to be broadly construed to include recurve bows, compound bows, and crossbows.

In another aspect of the present invention, an archery bow includes a riser having opposing end surfaces, a limb attached to and extending from each of the end surfaces, and a bowstring extending between the distal ends of the limbs. Preferably, the riser is fabricated from a thermoplastic polymer, a polymeric composite, or a combination thereof. Where a composite material is used, the matrix material for a riser can be thermoplastic. The thermoplastic composite can incorporate any number of different types of filler materials, such as, but not limited to fibers in strand or chopped form, or particulate material or combinations thereof. The filler can also be formed from different materials, such as, but not limited to, S-glass, E-glass, carbon fiber, KEVLAR® (aramid), SPECTRA® (ultra-high molecular weight polyethylene), natural fibers (basalt, hemp, and the like), or combinations of any of the foregoing.

In an embodiment of the present invention, the riser is formed from a hybrid material. A spine formed from a different polymer or composite than the rest of the riser, or from metal, is incorporated within the riser. Preferably, the spine follows the shape of the riser and extends longitudinally therealong. The spine can be embedded within the riser or positioned on the external surfaces of the riser. During use, the spine adds increased stiffness to the riser thereby enhancing the capability of the riser to withstand stress.

The present invention also resides in a method for producing a riser for an archery bow that includes the steps of introducing a polymeric composite into a mold from a first end of the mold to facilitate a particular orientation of components of the polymeric composite, molding the polymeric composite to produce a billet that approximates a net shape of the riser, and then machining the billet to the final shape of the riser.

A riser produced as described herein may be rigid, semi-flexible, or flexible. One advantage of the above-described invention is that the semi-flexible- or flexible risers can flex with at least a portion of each limb to supplement the force that will propel the arrow from the bow. Because the riser flexes, stresses at the joints between the riser and the limbs are reduced, which thereby reduces the overall stress on the bow. Accordingly, the useful life of the bow may be extended.

DETAILED DESCRIPTION OF THE PREFERRED EMBODIMENT

Figure 1:
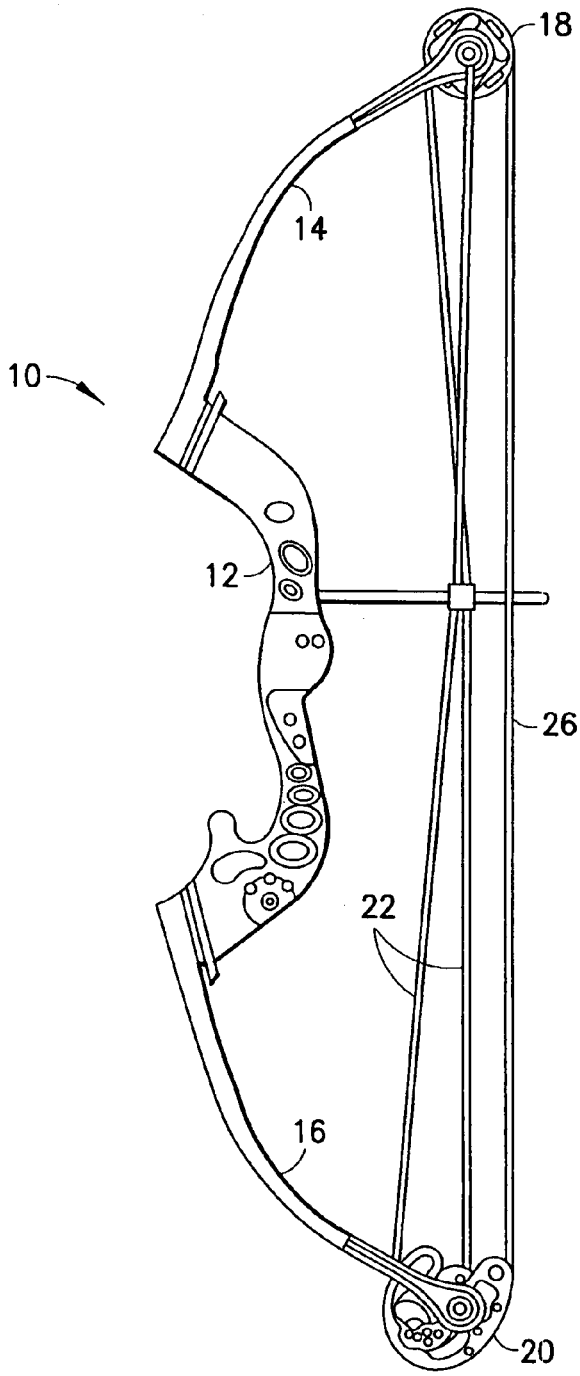
FIG. 1 is a schematic representation of an archery bow incorporating a riser of the present invention.

Referring to FIG. 1, one embodiment of a compound archery bow is shown generally at 10 and is hereinafter referred to as "bow 10." Bow 10 includes a riser 12, an upper limb 14 attached to an upper portion of the riser, a lower limb 16 attached to a lower portion of the riser, and a string arrangement connected between a pulley 18 and a cam 20 mounted to the distal ends of the upper limb and the lower limb, respectively. The string arrangement includes a string that is wound around the pulley 18 and the cam 20 to define a harness system 22 and a drawstring 26, a portion of which is receivable in the nock of an arrow. The drawstring 26 can be pulled back from the riser 12 in order to launch the arrow.

During use, tension, compression, and torque is exerted on the riser 12, the upper limb 14, and the lower limb 16 as the drawstring 26 is pulled back. Flexure of the upper limb 14 and the lower limb 16 stores energy in the bow 10, which is released when an arrow is launched, causing the upper limb 14 and the lower limb 16 to return to their respective unflexed positions, and the arrow to be propelled forward past the riser 12.

Figure 2:
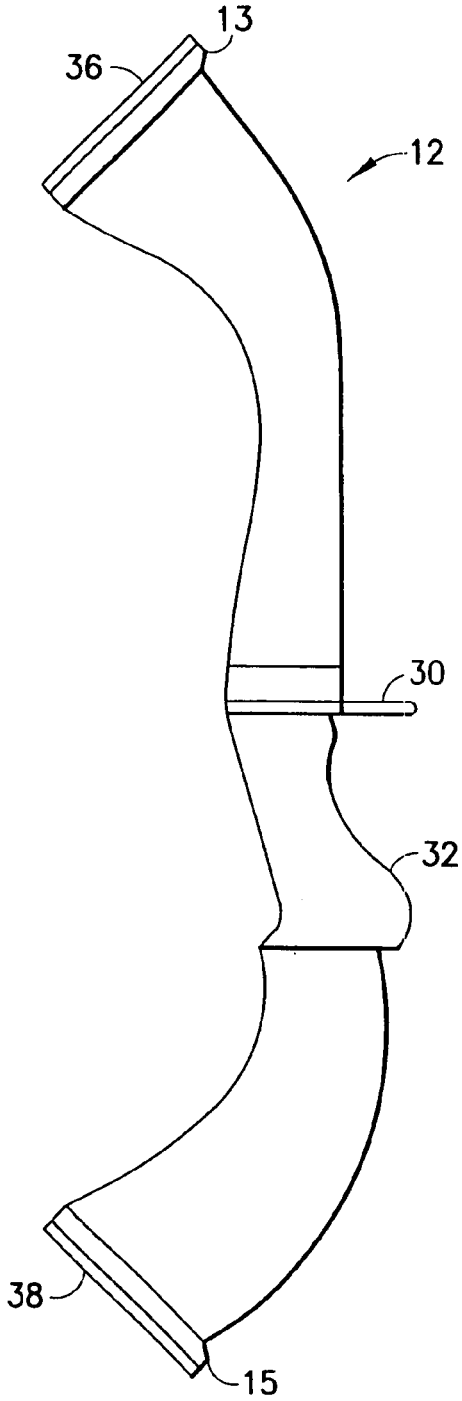
FIG. 2 is a schematic representation of a riser of the present invention.

The riser 12 is shaped to accommodate stress and stiffness and to impart the proper functionality to the bow. Referring to FIG. 2, the riser 12 includes an arrow rest 30 that supports the arrow once "nocked" onto the drawstring. The arrow rest 30 functions to guide the arrow as it is propelled from the bow. In the illustrated embodiment, a handle 32 is integrally formed with a central portion of the riser 12 to provide a grip for the user. The riser 12 further includes an upper end surface 36 and a lower end surface 38. An upper pocket 13 and a lower pocket 15 are either attached to or formed integrally with the respective upper end surface 36 and lower end surface 38. If the pockets are attached to the upper end surface 36 and the lower end surface 38 of the riser, the upper and lower pockets 13 and 15, respectively, are preferably attached after the riser 12 is completely formed. If the upper and lower pockets are formed integrally with the upper end surface 36 and the lower end surface 38, they may be formed using molding and/or machining techniques. In any embodiment, the upper and lower pockets 13 and 15, respectively, are each configured to receive a limb. The upper and lower pockets 13 and 15 can also be made of metal and mounted or attached to the riser 12.

Figure 3:
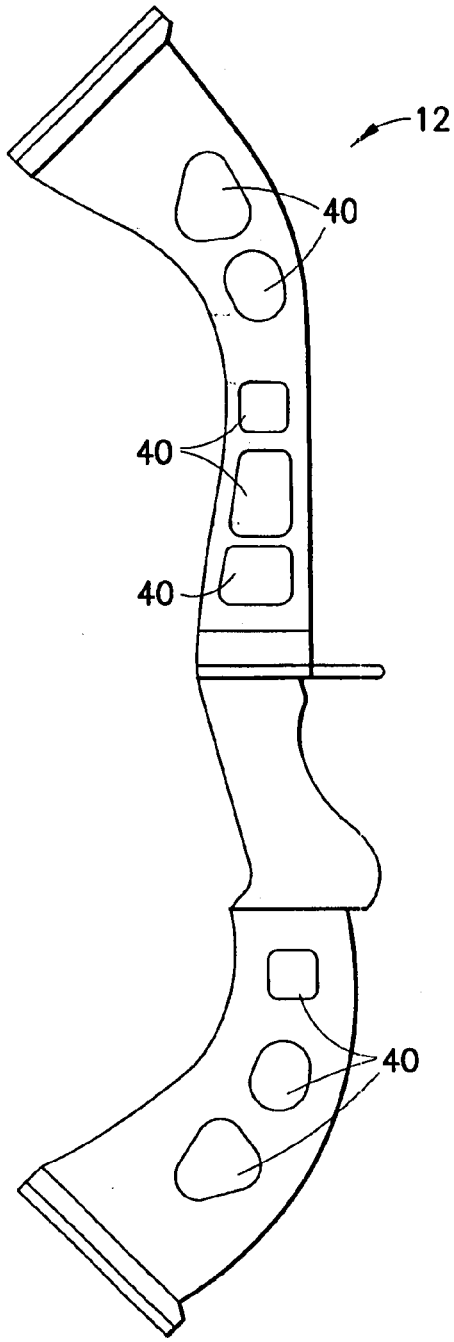
FIG. 3 is a schematic representation of a riser having holes and/or relief areas formed therein.

In FIG. 3, the riser 12 defines a plurality of holes 40 that may extend laterally through the riser or that may be formed as recesses or relief areas molded, stamped, cut, bored, or otherwise formed in the sides of the riser.

Figure 4:
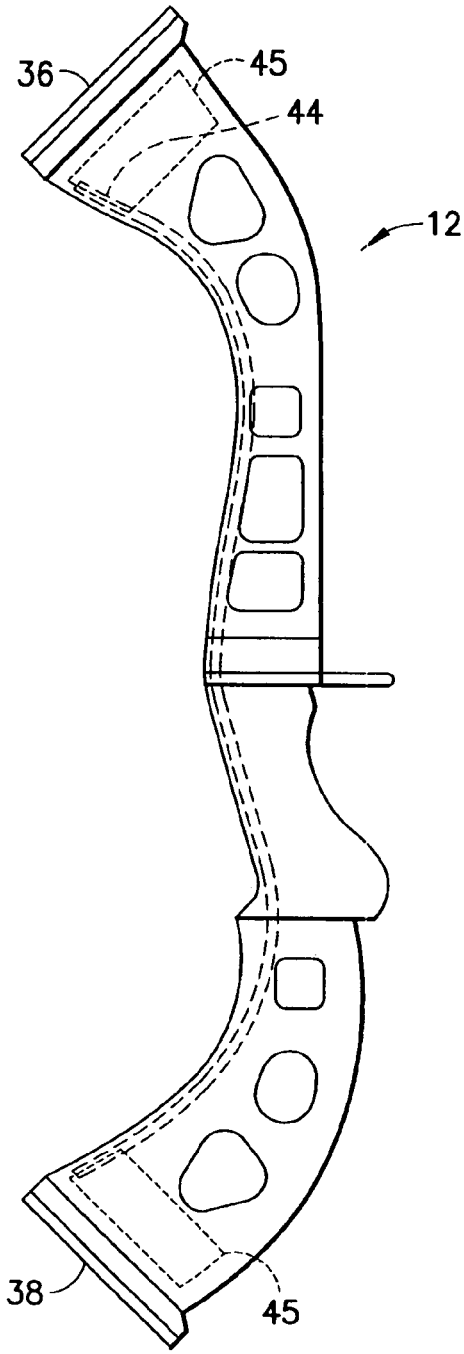
FIG. 4 is a schematic representation of a riser having a reinforcing spine inserted along a tension side thereof.

Referring now to FIG. 4, the riser 12 includes a rib or spine 44 to provide stiffness to the bow. The spine 44, in combination with the thermoplastic composite material of the riser 12, can act as a damping mechanism for the bow as a result of the different moduli of elasticity of the different components. For example, the incorporation of a titanium spine into a fiberglass thermoplastic composite produces desirable damping effects upon use of a bow incorporating the riser of the present invention.

The spine 44 is formed with the riser 12 or pre-formed and inserted into the riser. The spine 44 may be an elongated rod-like member having an angular, rounded, or complex cross section. The spine 44 may also be formed as a grid structure or from a bar, a hoop, a corkscrew or spiral member, a ladder, cable, woven strands, or a combination of any of the foregoing. Multiple structures may be assembled to form the spine 44. Materials from which the spine 44 may be fabricated include, but are not limited to, metals, alloys, rubbers, ceramics, cloth, composite materials, and combinations thereof. In the illustrated embodiments, the spine 44 is internal to the riser 12 and extends along the length thereof. The location of the spine 44 may be centrally positioned longitudinally in the riser 12, adjacent the compression side (back) of the riser, or adjacent the tension side (front) of the riser (as shown). Furthermore, the spine 44 could be connected to reinforcement plates 45 at or near the upper end surface 36 and lower end surface 38 of the riser 12 using mechanical fastening devices or by welding. While the spine 44 has been shown and described as being positioned internally within the riser 12, the present invention is not limited in this regard as the spine can also be located on external surfaces defined by the riser without departing from the broader aspects of the invention.

Figure 5:
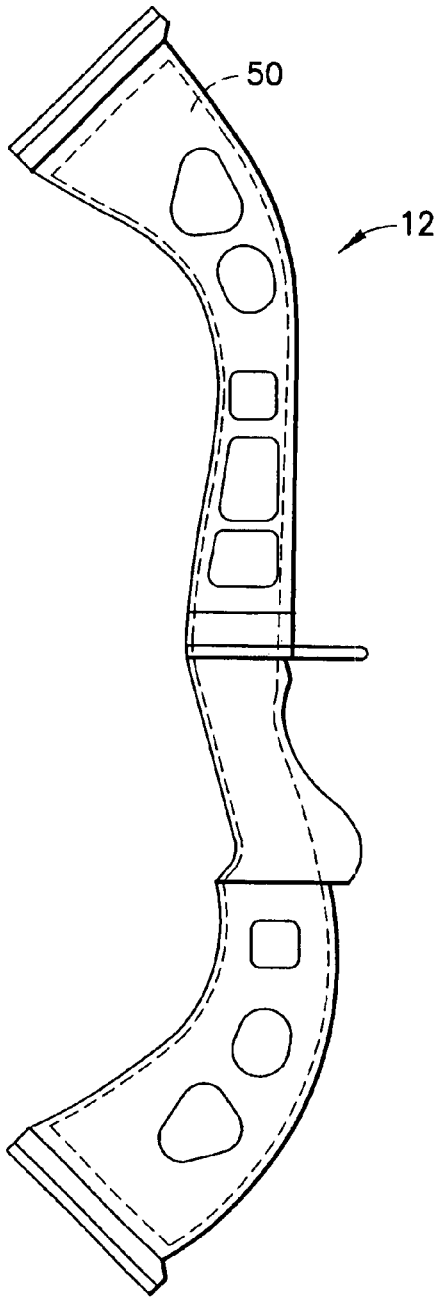
FIG. 5 is a schematic representation of a riser having a stamped plate inserted therein.

In FIG. 5, the riser 12 is shown as including a plate 50 (e.g., a stamped plate) to provide further stiffness to the bow. In forming the plate 50, a metal or alloy of suitable strength is employed and the plate configured to approximate the shape of the riser 12. Apertures may be formed in the plate to reduce the overall weight of the riser 12 and to allow the over-molded material to fill the apertures, thereby further securing the plate in position in the riser.

Referring to FIGS. 1-5, the riser 12 is pre-formed using a compression molding technique, an injection molding technique, or a combination of such techniques. The molding techniques are generally effected using a press or similar apparatus. In either case, once pre-formed, the riser 12 can be utilized as the finished product in its as-molded state, or it can be further machined to produce a more finished riser. Furthermore, the riser 12 may incorporate moldings in various colors as well as the incorporation of indicia or cosmetic effects.

In one embodiment of the present invention, the riser 12 is formed from a composite material that employs a thermoplastic matrix. The matrix material can be a high heat distortion thermoplastic polymer, a very high heat distortion thermoplastic polymer, or a combination of the foregoing polymers. The thermoplastic composite material can be a long fiber reinforced thermoplastic (LFRT), or an extra long fiber reinforced thermoplastic (XLFRT), or any combination thereof.

The thermoplastic composite can be made using a number of different types of reinforcing fibers. These include, but are not limited to, polyamides (e.g., aramid materials such as KEVLAR®). The fibers can also be carbon or glass fibers such as "S" or "E" glass. The composite material can also employ a reinforcing constituent in flake, pellet, or powder form, or a combination thereof. Other materials can be used as reinforcing fibers, such as, different glasses, cellulose-based materials, as well as natural materials such as hemp.

In another method of forming the riser 12, the thermoplastic composite material is introduced into a mold. The composite material can be injected into the mold using a plunger or injection system so that as the material is forced into the mold, the fibers are beneficially aligned.

When fibers are employed to reinforce the matrix material, the fibers can be long enough to extend from one end of the riser to the other. However, the present invention is not limited in this regard, as the fibers can also be shorter, or even chopped. Preferably, the fiber content of the final material fed to the mold is between about 10% by weight to about 80% by weight. When the spine 44 is employed, it is typically positioned in the mold prior to the composite material being introduced therein.

While a combination of the thermoplastic composite and the spine has been described, the present invention is not limited in this regard as the riser 12 can also be formed from a combination of thermoplastic polymer without fiber or other reinforcement molded or cast around the spine 44.

In yet another method of manufacturing the riser 12, polymer material or composite material is molded to produce a billet that approximates the net shape of the finished riser. In the actual molding process, the riser 12 is formed by positioning the mold in one of three positions. In the first position, the mold is placed so that the rear of the finished riser 12 (the side facing the user) faces down. Such a positioning allows for the integral molding of pockets into the upper and lower end surfaces on the riser 12. In the second position, the mold is placed so that the arrow rest faces down. This positioning allows holes to be molded laterally through and reliefs to be molded laterally into the riser 12. In the third position, the mold is placed so that the arrow rest faces up, which also allows holes and reliefs to be molded into and through the riser 12. If an injection molding process is utilized, inserts are used to form window pockets. If a compression molding process is utilized, an extrudate is either placed in the mold or secondarily extruded into the mold via a plunger/runner-type gate. The plunger/runner-type gate is located to equally distribute the extrudate into the mold cavity. In any of the molding positions, a plunger forces a charge of molten polymer into a cavity of the mold from one end, which facilitates the proper orientation of fibers or other components that may be added to the polymer. Also, in any of the molding positions, the spine 44 or stamped sheet 50 can be molded integrally with the billet.

After being molded, the pre-formed billet structure is machined to further form the riser 12. If pockets were not integrally molded into the riser 12 during the molding process, they may be machined into the structure at this point. Furthermore, if holes and reliefs were also not formed, then they may also be machined into the billet structure.

As an alternative to or in addition to the molding and machining process, the riser 12 may be formed using a thermoplastic composite form forging technique. This technique involves extruding a fiber filled thermoplastic composite sheet or charge in a basic cylindrical shape typically made from LFRT or XLFRT that approximates the peripheral shape of the riser 12. Several sheets or individual plies are interfacially assembled to approximate a billet. The spine 44, as described above, may be inserted between the plies. The assembled billet is then stamped or forged to form the riser 12 in its final shape. The fiber orientation can be kept consistent between plies, however, the present invention is not limited in this regard. Depending on the desired mechanical properties, the fiber orientation between plies can be varied. For example, the fibers in one ply can be oriented orthogonally or at any desired angle relative to the fibers in the next ply. The plies can also be compression molded or autoclaved to form the riser in final or near final form. This method of laying up several plies of composite material to form the riser can also be used without forging, such as, for example the layed-up plies of material can be cured under pressure in an autoclave.

Figure 6:
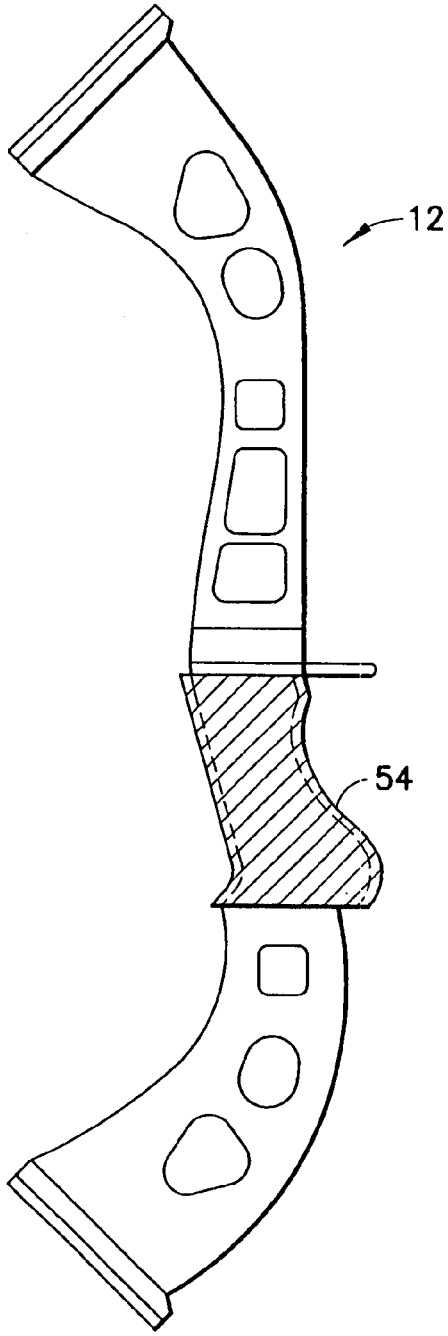
FIGS. 6 and 7 are schematic representations of risers having at least portions thereof that are over-molded.
Figure 7:
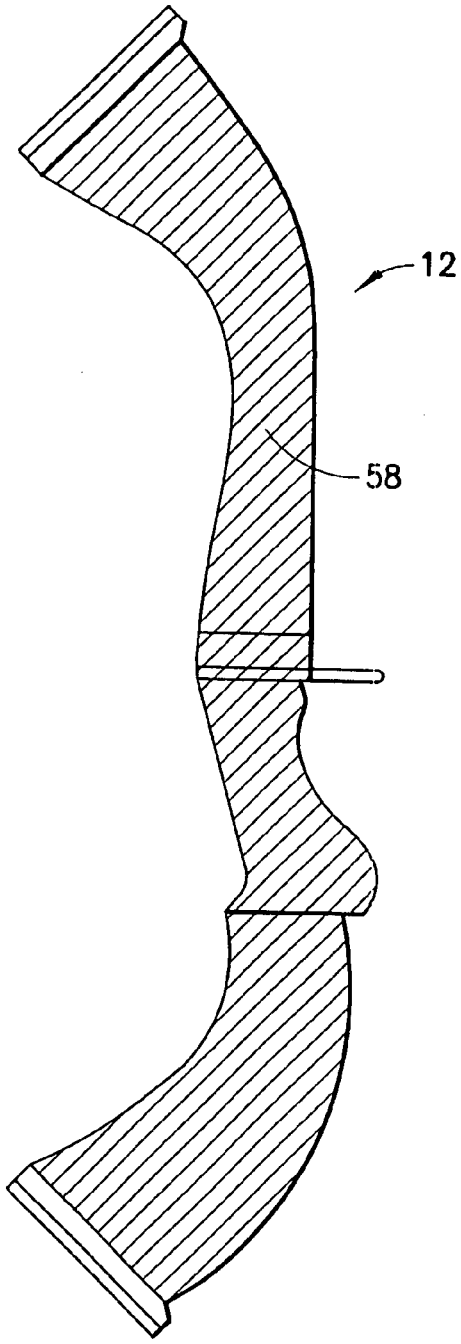

Referring now to FIGS. 6 and 7, at least portions of the riser 12 can be over-molded. In FIG. 6, a molded grip 54 is over-molded onto the handle. In FIG. 7, a coating 58 is over-molded over substantially the entire body of the riser 12. While over-molding (or "second level molding") may enhance the cosmetic aspects of the bow into which the riser 12 is incorporated (e.g., by providing a camouflage finish), it may also enhance the overall performance of the bow. In particular, over-molding of the riser 12 may provide damping functions that limit the vibration that results from the release of energy from the string. Additionally, the limb pockets may be over-molded into the riser 12. Over-molding may also be used to provide a more comfortable or ergonomic grip, as well as peripheral features such as the arrow rest, sights, and features for the attachment of archery-related devices.

In any embodiment, the thermoplastic material of the riser 12 may be combined with wood or laminated with wood to provide the desired finish.

Figure 8:
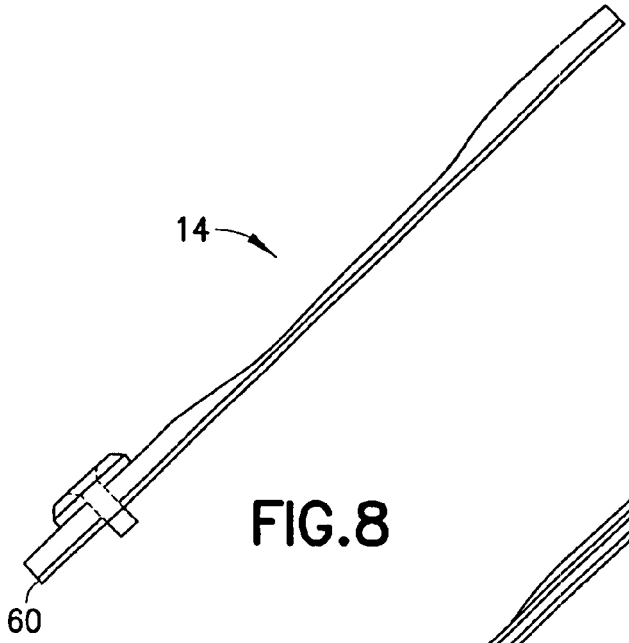
FIGS. 8-10 are schematic representations of limbs formed from layers of thermoplastic composite material.
Figure 9:
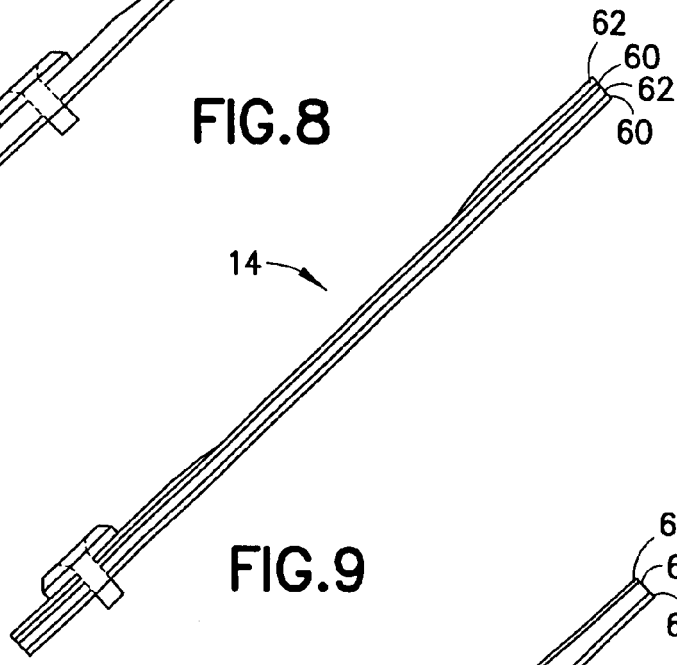
Figure 10:
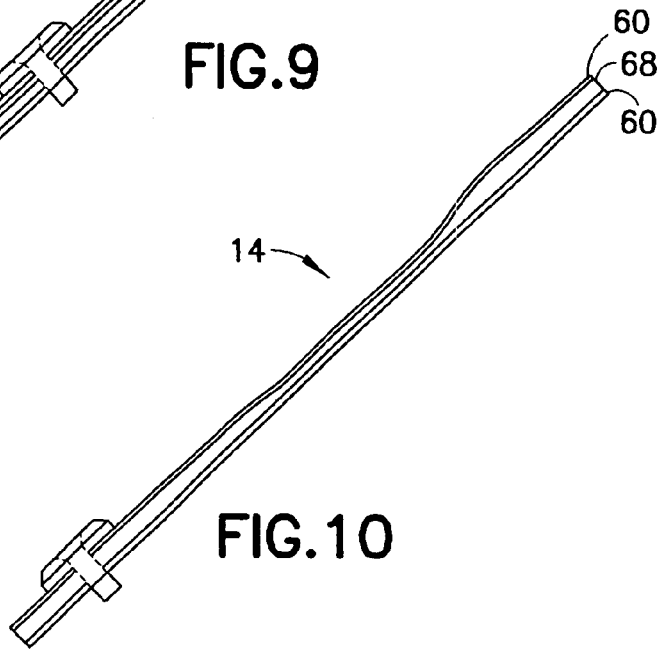

Referring now to FIGS. 8-10, the upper limb 14 includes a thermoplastic composite layer 60 that is added to the existing limb structure, the limb structure typically comprising a thermoset composite material or a combination of thermoset and thermoplastic composite materials. The limb could be made entirely from LFRT or XLFRT. In embodiments in which thermoplastic composite materials are incorporated, the thermoplastic composite materials may be layered in multiple directions to counteract forces associated with stresses imposed across the width of the limb. However, the present invention is not limited in this regard as the limb can also be found from a thermoplastic composite material and can incorporate a spine, without departing from the broader aspects of the present invention. Although the embodiments described below explicitly refer to the upper limb 14, it should also be understood that the structure described is also applicable to the lower limb of the bow.

As shown in FIG. 8, the thermoplastic composite layer 60, which introduces a damping function to the upper limb 14 when incorporated into the bow, may be made from a wrapped fiber-filled composite tape, a woven material, or a combination of wrapped tape and woven material. Materials that may be utilized for the composite tape or weave include, but are not limited to, nylons, urethanes, and the like. In such a structure, the upper limb 14 is wrapped, heated, and molded to provide uni-directional tape layers. A uni-directional composite tape layer is one wherein the fibers forming part of the composite tape are all oriented in the same direction.

The thermoplastic composite layer 60 may be laminated to the limb structure using an adhesive, a heat fusion technique, or the like. The thermoplastic composite layer 60 may be laminated to the tension surface of the upper limb 14, to the compression surface of the upper limb 14, as shown in FIG. 8, or to both the tension surface and the compression surface. In the alternative, the thermoplastic composite layers 60 may be alternatingly-arranged or otherwise interspersed with layers (shown at 62) of thermoset material to provide a sandwich-type structure, as is shown in FIG. 9.

Referring now to FIG. 10, in another embodiment of the limb 14, thermoplastic composite material can be formed into uni-directional layers 60 and combined with LFRT or XLFRT. The LFRT or XLFRT is disposed around a core 68 that may be a glass, carbon, wood, metal, or any other suitable material. The LFRT or LXFRT can also form the core material itself and be stress contour shaped during the molding process. The polymer/core is pre-molded into the shape of a fork. Stress contours are then molded into the pre-molded shape. When over-molding a woven laminate over a LFTP or XLFTP core, the resulting structure is compression molded to the desired shape. The resulting structure may then be over-molded with a woven laminate using adhesives and/or fusion heating to bond the structure together. In either embodiment, damping or cosmetic layers can be over-molded onto the laminated thermoplastic core structure.

Figure 11:
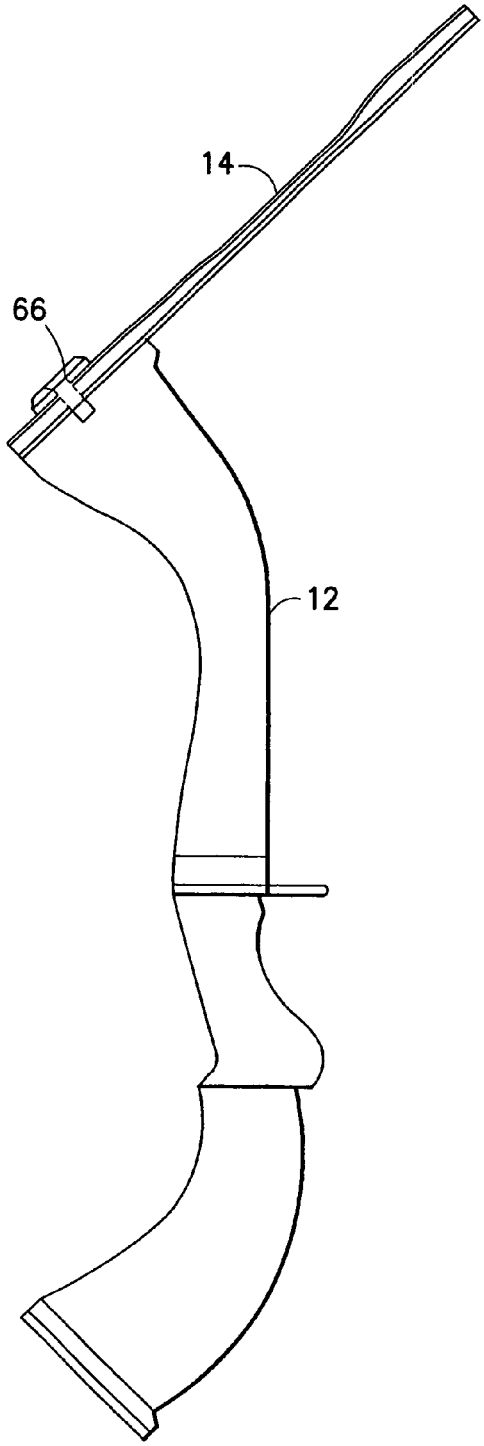
FIG. 11 is a schematic representation of a riser having an upper limb mechanically fastened thereto.
Figure 12:
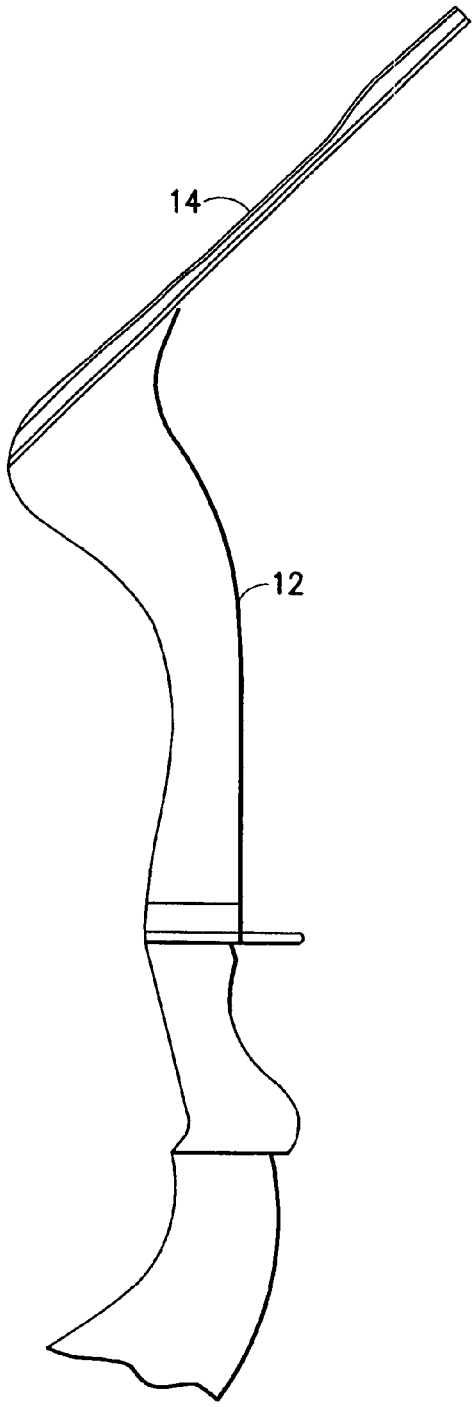
FIG. 12 is a schematic representation of a riser having an upper limb integral therewith.

Referring now to FIGS. 11 and 12, any of the upper limbs 14 as described above may be mechanically fastened to the riser 12 as shown in FIG. 11, or they may be integral with the riser as shown in FIG. 12. One type of mechanical fastening device is a bolt 66, which is inserted through or around at least a portion of the upper limb 14 and screwed into the upper end surface of the riser 12. Other types of mechanical fastening devices are within the scope of the invention. Mechanical fastening devices may also be used in conjunction with pockets to connect the upper limbs to the risers. If the limbs are made to be integral with the riser 12, they may be welded to the end surfaces thereof or formed integrally from a single billet.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

What is claimed is:

1. An archery bow, comprising:

a riser having a first end surface and an opposing second end surface;

a first limb having a first end and a second end, said first end of said first limb being attached to said first end surface of said riser;

a second limb having a first end and a second end, said first end of said second limb being attached to said second end surface of said riser; and a string connected between said second end of said first limb and said second end of said second limb; and said riser being fabricated from a thermoplastic polymer formed to a desired shape and flexibility selected from the group consisting of high heat distortion thermoplastic polymers, very high heat distortion thermoplastic polymers, and combinations thereof; and wherein said first limb and said second limb comprise a thermoplastic composite layer disposed over a thermoset material.

2. The archery bow of claim 1, wherein said thermoplastic polymer is a matrix material for said thermoplastic composite.

3. The archery bow of claim 2, wherein said thermoplastic composite further comprises reinforcing fibers.

4. The archery bow of claim 3, wherein said reinforcing fibers are formed from an aramid.

5. The archery bow of claim 3, wherein said reinforcing fibers are formed from a material selected from the group consisting of metal, glass, cellulose-based materials, natural materials, and combinations of the foregoing materials.

6. The archery bow of claim 1, wherein said thermoplastic polymer is molded using a technique selected from the group consisting of compression molding techniques, injection molding techniques, thermoplastic form forging techniques, and combinations of the foregoing techniques.

7. The archery bow of claim 1, further comprising, a first pocket formed in said first end surface of said riser, said first pocket being sized to receive said first limb, and a second pocket formed in said second end surface of said riser, said second pocket being sized to receive said second limb.

8. The archery bow of claim 7, wherein said first pocket and said second pocket are integrally molded into said riser.

9. The archery bow of claim 7, wherein said first pocket and said second pocket are machined into said riser.

10. The archery bow of claim 7, wherein said first pocket and said second pocket are over-molded into said riser.

11. The archery bow of claim 1, wherein said thermoplastic composite layer is a wrapped fiber-filled composite tape, a woven material, or a combination of wrapped fiber-filled composite tape and woven material.

12. The archery bow of claim 11, wherein said thermoplastic composite layer comprises a material selected from the group of materials consisting of nylons, urethanes, and combinations of the foregoing materials.

13. The archery bow of claim 1, wherein said thermoplastic composite layer is laminated to said thermoset material.

14. The archery bow of claim 1, wherein said first limb and said second limb are mechanically fastened to said riser.

15. The archery bow of claim 1, wherein said first limb and said second limb are integrally formed with said riser.

* * * * *